US009447553B2

(12) United States Patent
Zhang et al.

(10) Patent No.: US 9,447,553 B2
(45) Date of Patent: Sep. 20, 2016

(54) SHEAR CONNECTOR FOR CORRUGATED SHEET STEEL AND CONCRETE

(75) Inventors: Jiandong Zhang, Nanjing (CN); Xinzheng Liang, Nanjing (CN); Xin Wang, Nanjing (CN); Duo Liu, Nanjing (CN); Huaiyu Hu, Nanjing (CN); Jingkun Ji, Nanjing (CN)

(73) Assignee: JIANGSU TRANSPORTATION RESEARCH INSTITUTE CO., LTD. (CN)

( * ) Notice: Subject to any disclaimer, the term of this patent is extended or adjusted under 35 U.S.C. 154(b) by 302 days.

(21) Appl. No.: 14/344,917

(22) PCT Filed: Jul. 26, 2012

(86) PCT No.: PCT/CN2012/007920

§ 371 (c)(1),
(2), (4) Date: Mar. 14, 2014

(87) PCT Pub. No.: WO2013/040950

PCT Pub. Date: Mar. 28, 2013

(65) Prior Publication Data

US 2015/0139719 A1 May 21, 2015

(30) Foreign Application Priority Data

Sep. 22, 2011 (CN) ..... 2011 1 0283678

(51) Int. Cl.
*E04C 3/293* (2006.01)
*E01D 2/02* (2006.01)
(Continued)

(52) U.S. Cl.
CPC ..... *E01D 19/125* (2013.01); *E04C 3/293* (2013.01); *E01D 2/02* (2013.01); *E01D 2101/268* (2013.01); *Y10T 403/471* (2015.01)

(58) Field of Classification Search
CPC ..... E01D 19/00; E01D 19/125; E01D 2/04; E01D 2101/262; E01D 2/02; E04C 5/0645; E04C 5/01; E04C 3/293; Y10T 403/471
USPC ..... 52/334, 687, 688
See application file for complete search history.

(56) References Cited

U.S. PATENT DOCUMENTS 1,423,939 A * 7/1922 Jester ..... E04F 13/04 52/332
1,769,465 A * 7/1930 Rippstein ..... E04C 5/18 52/688

(Continued)

FOREIGN PATENT DOCUMENTS

CN 201125460 Y 1/2008
CN 201169779 Y 12/2008

(Continued)

OTHER PUBLICATIONS

PCT/CN20121/079200 International File Date: Jul. 26, 2012—International Search Report; Jiangsu Transportation Research Institute Co., Ltd. ; 3 pages.

*Primary Examiner* — Robert Canfield
(74) *Attorney, Agent, or Firm* — Schmeiser, Olsen & Watts, LLP

(57) ABSTRACT

A shear connector for corrugated sheet steel and concrete, comprises a flange plate welded at an upper end portion of the corrugated sheet steel, with more than one U-shaped steel channel welded in the longitudinal direction at an upper edge of the flange plate, the channel walls of each U-shaped steel channel being provided with two longitudinal sides, the left and right sides of the front and rear channel walls being respectively provided with corresponding holes or grooves, the left and right sides of the front and rear channel walls being respectively provided with corresponding holes or grooves, which penetrates and connects each of the steel channels; in the holes or grooves on the left and right sides of each U-shaped steel channel respectively, a vertically bent steel bar is provided, a bottom steel bar of each of the vertically bent steel bars penetrating the holes or grooves on the left or the right side in a longitudinal direction, both ends of the bottom steel bar being respectively bent upwards and extending to form a vertical steel bar.

2 Claims, 1 Drawing Sheet

(51) Int. Cl.
*E01D 19/12* (2006.01)
*E01D 101/26* (2006.01)

(56) References Cited

U.S. PATENT DOCUMENTS 3,378,981 A * 4/1968 Horne ..... E04C 5/18 52/677
3,596,421 A * 8/1971 Miller ..... E04B 5/40 52/333
3,736,716 A * 6/1973 Nishimura ..... E04B 5/29 52/334
6,212,848 B1 * 4/2001 Cooper ..... E04C 5/168 404/135
6,871,462 B2 * 3/2005 Azizinamini ..... E01D 19/125 52/333
7,624,550 B2 * 12/2009 Ospina ..... E04B 1/161 52/262
2003/0115815 A1 * 6/2003 Azizinamini ..... E01D 19/125 53/341

FOREIGN PATENT DOCUMENTS

CN 101691761 A 4/2010
CN 201671229 * 12/2010
CN 201952718 U 8/2011
CN 102359061 A 2/2012
CN 204238118 * 4/2015
JP 10-311045 A 11/1998
JP 2005-213754 A 8/2005

* cited by examiner

SHEAR CONNECTOR FOR CORRUGATED SHEET STEEL AND CONCRETE

FIELD OF TECHNOLOGY

This invention is in the field of bridges, as combined structures in civil engineering. It is designed for the shear connection structure of corrugated sheet steel or steel girders with concrete slabs.

BACKGROUND

The connection of the corrugated sheet steel with the concrete top slab and bottom slab has a direct bearing on the bearing capacity and safety performance of a bridge in composite structure, which is a highly critical technical link in the design of this type of bridges.

The design of the connection must take into account whether the horizontal shear force occurring between the steel and concrete materials can be effectively transferred, to make sure that these two different materials jointly support the load.

There are diversified types of connectors, roughly including steel bar connector, profile steel connector, cotter connector, and perforated steel plate connector, and according to different shear rigidity, connectors can be classified as rigid connector, elastic connector and flexible connector. However, each connection method has its respectively advantages and limits in construction works and in loading performance.

Therefore, it is urgent in the construction of composite bridge projects today to develop a simple, effective and applicable shear connector, and it will be of important significance in the development of composite bridges.

SUMMARY

The purpose of this invention is to provide a connector for corrugated sheet steel and concrete, and this connector can ensure effective transfer of the horizontal shear force occurring between the steel and concrete materials, with sufficient shear strength for the shear parts, and can also be conveniently fabricated and used in construction works.

The technical plan to realize the purpose of this invention is: a shear connector for corrugated sheet steel and concrete, comprising a flange plate welded at an upper end portion of the corrugated sheet steel, with one or more U-shaped steel channels welded in a longitudinal direction (in the extension direction of the corrugated sheet steel) at an upper edge of the flange plate, the channel walls of each U-shaped steel channel being provided with two longitudinal sides, the left and right sides of the front and rear channel walls being respectively provided with corresponding holes or grooves, the left and right sides of the front and rear channel walls being respectively provided with corresponding holes or grooves, which penetrates and connects each of the steel channels; in the holes or grooves on the left and right sides of each U-shaped steel channel respectively, a vertically bent steel bar is provided, a bottom steel bar of each of the vertically bent steel bars penetrating the holes or grooves on the left or the right side in a longitudinal direction, both ends of the bottom steel bar being respectively bent upwards and extending to form a vertical steel bar.

In this invention, U-shaped steel channel is used, as it has two vertical walls, compared with L-shaped steel, it can provide larger area to resist the horizontal shear load in the longitudinal direction of the bridge, to increase the shear resistant performance. The vertically bent steel bars are designed to resist the bending moment and tensile load in the lateral direction of the bridge. In the workshop fabrication, it can be easily made by opening grooves on both sides of the steel channel and welding them on the flange steel sheet.

As a further improvement of this invention, the holes or grooves on the left and right sides of the said channel walls are lateral grooves, and the front and rear channel walls are in "I" shape. In the site construction works, the longitudinal steel bars and vertically bent steel bars can be directly put into the lateral grooves opened from side, with the advantages of reduced hole threading operation and convenient work as compared with perforated steel plate connector.

The beneficial effect of this invention is: with laterally grooved U-shaped steel channel in this connector, it has effectively increased the longitudinal shear area as completed with conventional L-shaped steel and other perforated steel plate connectors, with the advantages of saving materials and reducing welding work;

By making grooves in the channel steel and setting longitudinal penetrating steel bars and vertically bent steel bars, the overall loading performance of the connector and girder can be increased with coordinated deformation; in addition, the main parts of this connector can be fabricated by welding in a workshop, ensuring welding quality and reducing site work quantity, compared with conventional holes, the lateral grooves make it easier to pub the longitudinal penetrating steel bars and vertically bent steel bars into the channel steel, thus reducing the difficulties in work and shortening the work period.

BRIEF DESCRIPTION

DETAILED DESCRIPTION

In the following, this invention is further described in conjunction with attached drawings and embodiment.

Figure 1:
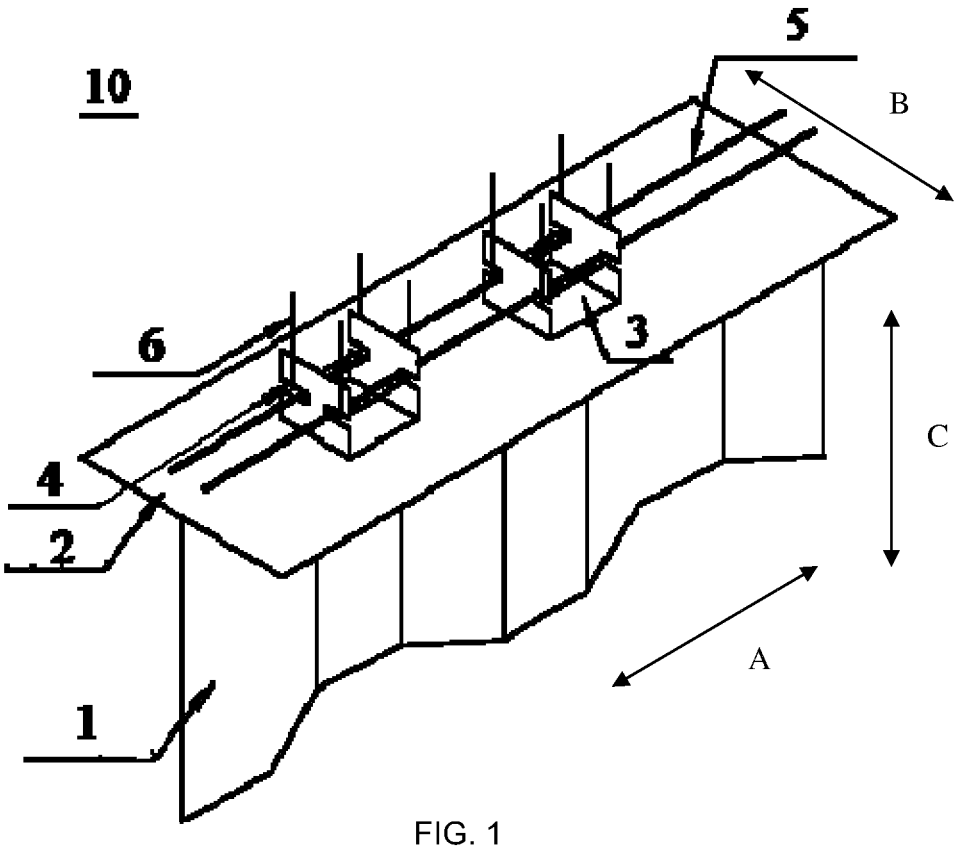
FIG. 1 is the schematic diagram of the structure of Embodiment 1 of this invention.

As shown in FIG. 1, a shear connector for corrugated sheet steel and concrete 10, comprises a corrugated sheet steel 1 and flange plate 2 welded at the upper end of the corrugated sheet steel, in the longitudinal direction A at an upper end of flange plate 2 (in the extending direction of the corrugated sheet steel) two U-shaped steel channels 3 are welded, the channel wall of each of the U-shaped steel channel 3 is located on the longitudinal side (in the extending direction of the corrugated sheet steel), on the left and right sides of the front and rear channel walls respectively, corresponding open grooves 4 extending in the lateral direction B are provided, within the grooves 4 on both left and right sides are respectively provided with longitudinal penetrating steel bars 5, which penetrate and connect two steel channels 3.

Figure 2:
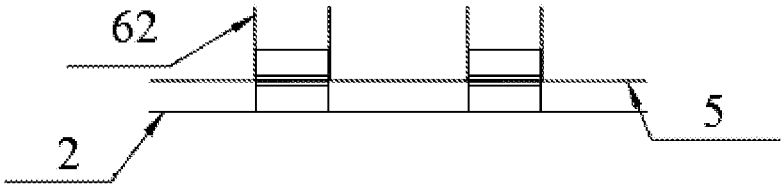
FIG. 2 is the main view of the upper part of the connector in Embodiment 1 of this invention.
Figure 3:
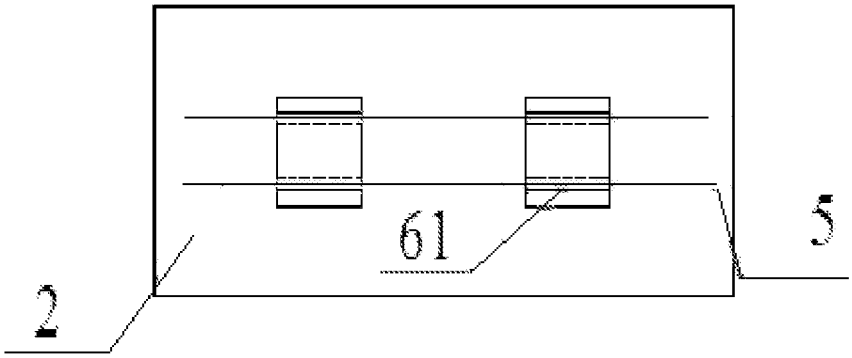
FIG. 3 is the top view of Embodiment 1 of this invention.

As shown in FIGS. 2 and 3, in the left and right grooves 4 of each U-shaped steel channel respectively, a vertically bent steel bar 6 is provided, the bottom steel bar 61 of each vertically bent steel bar 6 penetrating longitudinally the groove 4, both ends of the bottom steel bar 61 being bent upwards and extending in vertical direction C to form a vertical steel bar 62.

The corrugated sheet steel 1, flange plate 2 and U-shaped steel channel 3 are fabricated and welded in the workshop, and the grooves on both sides of the U-shaped steel channel 3 are also made in the workshop.

On the construction site, longitudinal penetrating steel bar 5 and vertically bent steel bar 6 are put into the lateral groove 4 of U-shaped steel channel 3, and fixed temporarily as appropriate, then concrete is placed in-situ, to form the shear connector for corrugated sheet steel and concrete 10.

The invention claimed is:

1. A shear connector for corrugated sheet steel and concrete, comprising:

a flange plate welded at an upper end portion of a corrugated sheet steel, wherein a plurality of U-shaped steel channels are welded in a longitudinal direction at an upper edge of the flange plate, each of the plurality of U-shaped steel channels having two longitudinally spaced channel walls, the two channel walls of each of the plurality of U-shaped steel channels including at least one corresponding groove, the at least one corresponding groove on the two channel walls of each of the plurality of U-shaped steel channels being respectively provided with a plurality of longitudinal penetrating steel bars, which penetrate and connect each of the plurality of U-shaped steel channels;

wherein, in the at least one corresponding groove on the two channel walls of each of the plurality of U-shaped steel channels, a vertically bent steel bar is provided, and a bottom steel bar of each of the vertically bent steel bars penetrating the at least one corresponding groove on the two channel walls of each of the plurality of U-shaped steel channels in a longitudinal direction, both ends of the bottom steel bar being respectively bent upwards and extending to form a vertical steel bar.

2. The shear connector as described in claim 1, wherein, the at least one corresponding groove on the two channel walls of each of the plurality of U-shaped steel channels are lateral grooves, and the two channel walls of each of the plurality of U-shaped steel channels are in an "I" shape.

* * * * *